US005653635A

United States Patent [19]

Breeding

[11] Patent Number: 5,653,635

[45] Date of Patent: Aug. 5, 1997

[54] WAGERING SOLITAIRE GAME

[75] Inventor: John G. Breeding, Eden Prairie, Minn.

[73] Assignee: Shuffle Master, Inc., Eden Prairie, Minn.

[21] Appl. No.: 621,530

[22] Filed: Mar. 25, 1996

[51] Int. Cl.[6] ..... A63F 3/06

[52] U.S. Cl. ..... 463/11

[58] Field of Search ..... 463/9, 10, 11, 463/12, 13; 273/292, 296, 274

[56] References Cited

U.S. PATENT DOCUMENTS

| | | | |
|---|---|---|---|
| 3,663,021 | 5/1972 | Whippo | 273/296 |
| 3,825,265 | 7/1974 | Pitkanen et al. | 273/126 R |
| 4,072,930 | 2/1978 | Lucero et al. | 340/152 T |
| 4,099,722 | 7/1978 | Rodesch et al. | 273/143 R |
| 4,264,000 | 4/1981 | Burton | 194/97 R |
| 4,294,451 | 10/1981 | Wollner | 273/308 |
| 4,441,515 | 4/1984 | Goepner | 133/5 R |
| 4,475,564 | 10/1984 | Koester et al. | 133/8 R |
| 4,527,798 | 7/1985 | Siekierski et al. | 273/86 R |
| 4,530,499 | 7/1985 | Breslow | 273/1 GC |
| 4,604,065 | 8/1986 | Frazer et al. | 434/331 |
| 4,611,808 | 9/1986 | Palmer | 273/138 A |
| 4,636,951 | 1/1987 | Harlick | 364/412 |
| 4,648,600 | 3/1987 | Olliges | 273/138 A |
| 4,676,506 | 6/1987 | Crouch | 273/143 R |
| 4,706,961 | 11/1987 | Singleman et al. | 273/274 |
| 4,713,787 | 12/1987 | Rapp | 364/717 |
| 4,744,566 | 5/1988 | Malavazos et al. | 273/357 |
| 4,756,531 | 7/1988 | DiRe et al. | 273/138 A |
| 4,760,527 | 7/1988 | Sidley | 364/412 |
| 4,775,155 | 10/1988 | Lees | 273/139 |
| 4,836,553 | 6/1989 | Suttle et al. | 273/292 |
| 4,837,728 | 6/1989 | Barrie et al. | 364/412 |
| 4,948,134 | 8/1990 | Suttle et al. | 273/85 CP |
| 5,022,653 | 6/1991 | Suttle et al. | 273/85 CP |
| 5,078,405 | 1/1992 | Jones et al. | 273/309 |
| 5,112,060 | 5/1992 | Jones | 273/309 |
| 5,120,068 | 6/1992 | Tablan | 273/293 |
| 5,136,686 | 8/1992 | Koza | 395/13 |
| 5,170,345 | 12/1992 | Poole | 364/410 |
| 5,275,400 | 1/1994 | Weingardt et al. | 273/85 CP |
| 5,288,081 | 2/1994 | Breeding | 273/292 |
| 5,342,049 | 8/1994 | Wichinsky et al. | 273/119 R |
| 5,362,064 | 11/1994 | Lofink et al. . | |
| 5,395,110 | 3/1995 | Yamazaki et al. | 273/108 |
| 5,417,430 | 5/1995 | Breeding | 273/292 |
| 5,437,462 | 8/1995 | Breeding | 273/292 |
| 5,476,259 | 12/1995 | Weingardt | 273/85 CP |

OTHER PUBLICATIONS

Morehead, Albert H., and Mott–Smith, Goeffrey, *Hoyles Rules of Games,* Second Revised Edition, Solitaire, pp. 193–207.

Scarne, John, Scarnes Encyclopedia of Card Games, Harper & Row, Publishers, Chapter 21, Solitaire and Patience Games, pp. 388–424.

*Primary Examiner*—George Manuel
*Attorney, Agent, or Firm*—Janal M. Kalis

[57] ABSTRACT

The present invention includes a method for playing a game of solitaire as a wagering game. The method includes a step of a player paying a fee. Once the fee is paid, the player selects a shuffled deck of cards to play a first game of solitaire from one or more shuffled decks. Each of the shuffled decks is displayed with a predetermined number of upturned cards. The player plays the first game to either win or lose the game. If the player wins the first game, the player may pay a fee to play a second game of solitaire and is eligible to win a winner's bonus for winning the second game. The player selects a shuffled deck of cards to play the second game from one or more shuffled decks. Each of the shuffled decks is displayed with a predetermined number of upturned cards. The player plays the second game and either wins or loses the second game. The player collects the winner's bonus and is eligible to play a third game for a larger winner's bonus provided that the player wins the second game.

29 Claims, 4 Drawing Sheets

WAGERING SOLITAIRE GAME

BACKGROUND OF THE INVENTION

The present invention relates to a wagering solitaire game.

The game of solitaire has provided entertainment and relaxation for multitudes of individuals when played either as a game with a deck of cards or as a video game. The video game of solitaire is typically played by manipulating images of cards displayed on a personal computer.

The popularity of each of the solitaire card game and the video solitaire card game is due to a one-on-one interaction that individuals have with either the cards directly or with an image of the cards on a video screen of the personal computer. People do not usually compete with other people in solitaire but work with a particular hand of cards to achieve a desired result. Typically for a solitaire game, the most sought after result is to turn over all of the cards and arrange the cards in order of color and rank. To accomplish this task is to win the game. For another type of solitaire game, the winner must turn up and remove all cards from a tableau. Removal of cards is based upon rules specific for each solitaire game.

The card game of solitaire and the game of video solitaire are games requiring luck and skill. To win a game of one type of solitaire, Klondike solitaire, a player must turn over all cards, other than a joker, of a deck and must order the cards according to rank and color. For another type of solitaire, Pyramid solitaire, the player may remove cards from a tableau if the cards are kings and if the cards, in pairs, total thirteen. To win Pyramid solitaire, the player must remove all of the cards.

The deck of cards may be shuffled to an order that prevents the player from winning. Alternately, cards may be shuffled to an order that permits the player to win, provided the player is attentive and skilled. Manually shuffling the deck of cards introduces elements of randomness and luck into the game of solitaire.

For a conventional video solitaire game, a computer shuffles the cards according to a conventional random card shuffling algorithm. This type of video solitaire game does not include an adjustment for a player's level of skill in playing the game of solitaire. For the card game of solitaire, the shuffling of each hand of cards randomizes the order of the cards in the deck.

Other games for computers have been developed which depend upon the intellectual, psychosomatic and emotional state of a player. One such game is described in the Yamazaki et al. patent, U.S. Pat. No. 5,395,110. The Yamazaki et al. patent describes a game machine that measures the psychosomatic and emotional state of a player and utilizes this information in order to adjust features of a pachinko game. The player's psychosomatic state is then one component used to make adjustment in the difficulty of the game.

The Frazer et al. patent, U.S. Pat. No. 4,504,065, describes a detector pen that discriminates between areas on a printed substrate such as paper by detecting either magnetic energy, infrared energy, or electrical energy of different parts of a printed surface. The detector pen may be used on games such as quiz games in order to identify the selection of a correct answer.

The Tablan patent, U.S. Pat. No. 5,120,068, describes a domino game where some of the domino pieces have rotatable or convertible end sections. The extra sides significantly enhance the complexity of the game of dominos.

The Breslow et al. patent, U.S. Pat. No. 4,530,499, describes a video game in which images are controlled by a player. An image, such as a little person, places domino images on a screen to protect against interference by intruder images. The intruder images can produce a chain reaction of falling dominos. The player selects either a place mode that allows the player image to place additional dominos or a protect mode for protecting itself or the dominos from an intruder. Difficulty in the game may be increased by adjusting one or more of the complexity of the domino pattern, the time duration and the intruder images. The game does require a generation of data for placement of domino images and little person images at predetermined intervals in an array.

The Koza patent, U.S. Pat. No. 5,136,686, describes the use of a non-linear genetic algorithm to solve problems.

The Wichinsky et al. patent, U.S. Pat. No. 5,342,049, describes a gaming machine with a random selection feature and a skill feature. The game permits a player to initially play a game of chance having features of a conventional slot machine game. If the player loses a game of chance, a game of skill is activated. The game of skill has many features in common with a pinball type game.

Other games have been developed with a betting format having more than one step. A game, "Let It Ride," described in U.S. Pat. No. 5,288,081 describes a wagering game where the player places a three-part bet. Cards are then dealt by a dealer, two face down to the dealer and three face down to each player. Players inspect or "sweat" their cards and the dealer gives each player the choice of withdrawing or leaving a first part of the bet. Each player decides whether or not to withdraw and the dealer then turns over one of the cards and gives each player the option of withdrawing or leaving a second part of the bet. The players decide, their cards are shown and all remaining bets are resolved.

Another game developed by Mr. Richard Canfield earlier this century included steps of buying a deck of cards for fifty dollars and playing a game of Canfield solitaire. The player received five dollars for each card in the foundation at the end of the game. The player received $500 for moving all cards to foundation piles. This game is described in *Hoyle's Rules and Games*, edited by Albert Moorehead and Geoffrey Mott-Smith, published in 1946.

SUMMARY OF THE INVENTION

The present invention includes a game of electronic solitaire that rewards luck and skill. The game includes a step of a player paying a fee prior to selecting one of two or more solitaire decks to play a first game. The game also includes a step of electronically generating at least two shuffled decks of cards for the solitaire game. The two or more decks are displayed to the player so that the player views a prescribed number of upturned cards of each deck after payment of the fee.

Another mechanism is provided so that the player selects one of the solitaire decks to play a second game for a winner's bonus provided the player has won the first game and pays a fee to play the second game.

Another mechanism is provided so that the player is paid the winner's bonus provided the player wins the second game.

Yet another mechanism is provided so that the player can pay a fee to play a third game for a winner's bonus provided the player has won the second game. Finally, a mechanism is provided so that the player is paid the third game winner's bonus provided the player wins the third game. The third game bonus is greater than the second game bonus.

DETAILED DESCRIPTION OF THE DRAWINGS

DETAILED DESCRIPTION OF PREFERRED EMBODIMENTS

Figure 1:
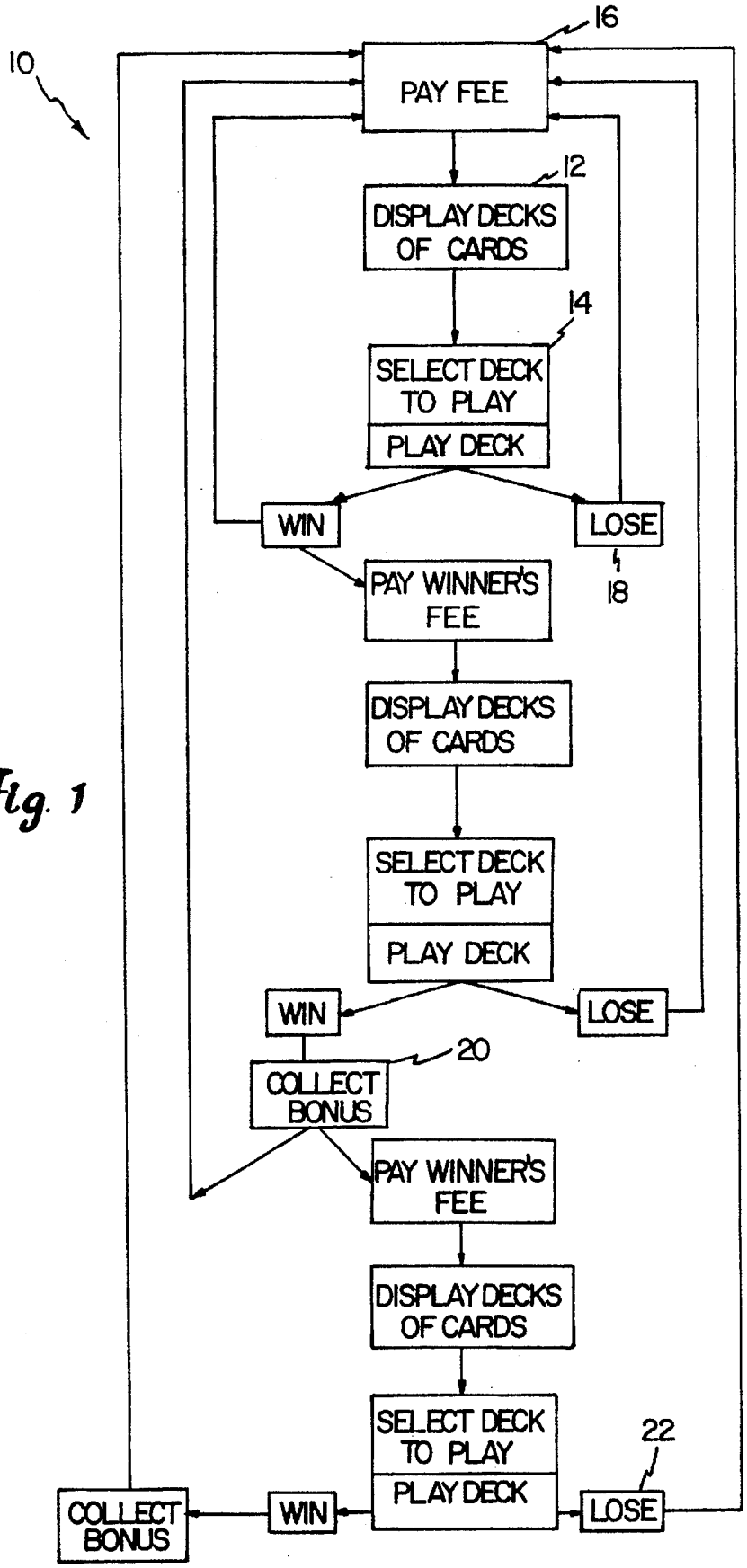
FIG. 1 is a schematic view of one embodiment of the game of the present invention with a winner's fee arrangement.

A game of solitaire of the present invention, illustrated generally at 10 in FIG. 1, includes steps of a player paying a fee to play the game 16, electronically generating and shuffling at least two decks of cards for playing solitaire and presenting an initial video display of the two or more solitaire decks with a number of cards turned up as shown schematically at 12. The player selects one of the decks to play after paying the fee as shown at 14. The player plays the first game. If the player wins the first game, the player has an opportunity to play a second game and win a winner's bonus upon paying a second fee and selecting one of two or more shuffled decks, electronically generated. If the player loses the first game, the player forfeits the opportunity to win the winner's bonus if the player plays a second game, as shown at 18.

Upon paying the second fee, the player selects the deck to play, plays the second game and is paid the bonus provided the player wins the second game shown at 20. The winning player is also eligible to play a third game for a third game winner's bonus. The losing player may pay a fee to play a game of solitaire but is not eligible to win a winner's bonus, as shown at 22.

If the winning player chooses to play the third game, the player must pay a prescribed fee. The player again selects a deck to play from two or more decks with upturned cards. If the player wins the third game, the player receives a third game winner's bonus payment within a range that may be many times the second game bonus. The player is also eligible to play another game for a winner's bonus greater than the third game bonus. If the player loses, the player may pay a fee to play a game of solitaire but is not eligible to win a bonus in the next subsequent game played. While four games have been described, it is understood that a player may play a game for a winner's bonus as long as the player won the previous game.

For the first time, the present invention provides a game of electronic solitaire that may be played as a game that rewards luck and skill. The skill and luck of individual solitaire players is rewarded by payment of a winner's bonus for winning a game that is played upon payment of the fee by the player. The winner's bonus payment escalates with cumulative wins after winning a first game. The failure of a player to win a game prevents the player from winning a winner's bonus in the next game of solitaire played. In one embodiment, the loss of a game generates an electronic signal that results in a lockout of the player from playing additional games for the winner's bonus until the player wins a game.

The game of the present invention may be played on any electronic device capable of generating a display of cards of two or more decks, and capable of processing a variety of shuffling algorithms. The device must also be capable of responding to commands from the player related to manipulating cards; capable of receiving a fee and capable of dispensing a bonus. It is also contemplated that the game may be played on an electronic gaming machine in an approved casino.

Devices suitable for use include personal computers capable of receiving the game of the present invention through a modem or other type of mechanism. Another suitable device is an electronic gaming machine such as exists in casinos. This gaming machine displays the decks of cards, shuffles the cards, permits a player to view and manipulate the cards once the player pays a fee, identifies a winner player and pays out a winner's bonus.

The game of the present invention utilizes a conventional 52-card deck, electronically generated. The cards run in sequence for play in the order of ace (low), two, three, four, five . . . jack, queen and king (high). Winning sequences may run in either ascending of descending order. Suits have no comparative rank. Hearts and diamonds form one color and spades and clubs form another color.

Each hand is displayed in a pattern or "tableau" particular to the game of solitaire being played. Cards displayed as face-up are known as "foundation" cards. Sequences built upon the foundation cards are foundation piles. The object of a conventional solitaire game and one of the objects of the game of the present invention is to play cards onto foundation piles. Playing cards in ascending sequence is "building up." Playing cards in descending sequence is "building down." Playing cards of the same suit is "building in suit." Playing cards in alternate colors is "building in alternate colors." These conventional rules of solitaire are described in *Scarne's Encyclopedia of Card Games*, written by John Scarne in 1983. The rules are also described in the book *According to Hoyle* by Richard Frey.

As used herein, a "deck" refers to an array of shuffled cards, arranged in a tableau with a number of upturned cards displayed to a player after payment of the fee. The deck also includes any foundation cards. Cards that are not part of the tableau or the foundation are "stock" cards. Stock cards, also part of the deck, are used to build the foundation piles.

Stock cards are turned up sequentially. Once turned up, the stock cards may be placed on a foundation pile, placed in the tableau, placed on a waste pile or returned sequentially to the stock, as appropriate. In one embodiment, single stock cards are upturned sequentially. In another embodiment, three stock cards are upturned at a time, sequentially.

In one embodiment of the present invention, the player may run through the stock cards one time only. In another embodiment, the player may run through the stock cards multiple times.

A "game" as used herein refers to the method of the present invention of paying a fee, selecting a deck to play from at least two decks and playing solitaire with the deck. A "game" also refers to steps of paying a fee and playing a predetermined number of decks to a win and loss for each deck. A winner of this game has the largest number of wins.

An objective of forms of solitaire other than Klondike solitaire, such as Pyramid, is to remove all cards from a tableau. Cards are removed in accordance with prescribed rules. For the game of Pyramid, kings are removed and pairs of cards totalling thirteen are removed.

Variations in solitaire played with a single deck include conventional games of Simple Addition, Block Solitaire, Baroness, Fourteen Puzzle, Pyramid, Nestor, Monte Carlo, Decade, Betrothal, Accordian, Golf, Hit or Miss, Idiot's Delight, Royal Flush, Perpetual Motion, Clock, Eight-Day Clock, Auld Lang Syne, Sir Tommy, Puss Corner, Calculation, Four Kings, Quadrille, Thirteen Down, Queen's Audience, La Belle Lucie, Fortress, Fifteens, Storehouse (Thirteen Up, The Reserve), Four Seasons (Corner Card, Vanishing Cross), Gaps, Double Jump, Las Vegas Solitaire, Klondike and Scorpion.

One preferred solitaire game used in the game of the present invention is Klondike and variations of Klondike such as Agnus, Thumb and Pouch, Whitehead, Westcliff, Aces Up, Spiderette, Will o' the Wisp, Four Seasons, Simplicity, Fortune's Favor, Canfield, Selective Canfield, Chameleon, Storehouse, Gate, Beleaguered Castle, Citadel, Streets and Alleys, Fortress, Chessboard, Le Belle Lucie, Trefoil, Flower Garden, Shamrocks, King Albert, Baker's Dozen, Good Measure, Perseverance, Little Spider, Grandfather's Clock, Bisley, Pendulum, Las Vegas Solitaire, Poker Solitaire and Cribbage Solitaire.

It is also contemplated that the game of the present invention may be played with two-deck solitaire games such as Double Klondike, Canfield, Patriarchs, Contra-Dance, Sultan of Turkey, Windmill, The Fan, Precedence, Salic Law, Faerie Queen, Intrigue, Colorado, La Nivernaise, Tournament, Blockade, Miss Milligan, Spider, Forty Thieves, Limited, Lucas, Maria, Number Ten, Rank and File, Indian, Emperor, Midshipman, Octave, Busy Aces, Rouge et Noir, Congress, Harp, House in the Wood, House on the Hill and Intelligence. Rules for playing each of these games are described in *Scarne's Encyclopedia of Card Games* and *According to Hoyle.*

The games listed differ in the number of cards and arrangement of cards in the tableau. For instance, in the game of Klondike, the tableau includes seven rows of cards with each row having a number of cards ranging from one to seven. The completed tableau includes seven piles increasing in number from one to seven cards, with the top card of each pile face up and the rest face down. The foundations are the four aces, which, as they become available, are moved into a row above the tableau and are built up in suit to kings. A winning hand completes the build up in each suit from aces to kings.

In one embodiment of the present invention, three decks of cards are displayed at the beginning of each game, after a player pays a fee to play the game. For a game of Klondike solitaire, seven cards of each deck are turned up. The player selects one of the three decks to play. It is contemplated that in other embodiments, the player selects a deck from a display of two decks or a display of more than three decks. In one other embodiment, the player plays a single deck which is displayed.

In one embodiment, the solitaire decks for each game are generated randomly using a random card shuffling based algorithm. Such an algorithm would be one that is conventionally used to electronically shuffle cards for other types of games such as video poker.

In another embodiment, the solitaire decks are generated utilizing an algorithm based upon a non-linear equation or an array of non-linear equations derived from empirical data. It has been empirically found that particular card arrangements, when played by attentive players, have outcome probabilities that can be quantified.

Solitaire, unlike other card games, is typically a game where a player plays against the arrangement of the cards in a deck, rather than against another player. One preferred embodiment of the game of the present invention permits the player to make an initial judgment on which one of several decks to play based upon viewing the upturned cards. For the game of Klondike, for instance, the player views seven up-turned tableau cards for each of the decks displayed.

Figure 2:
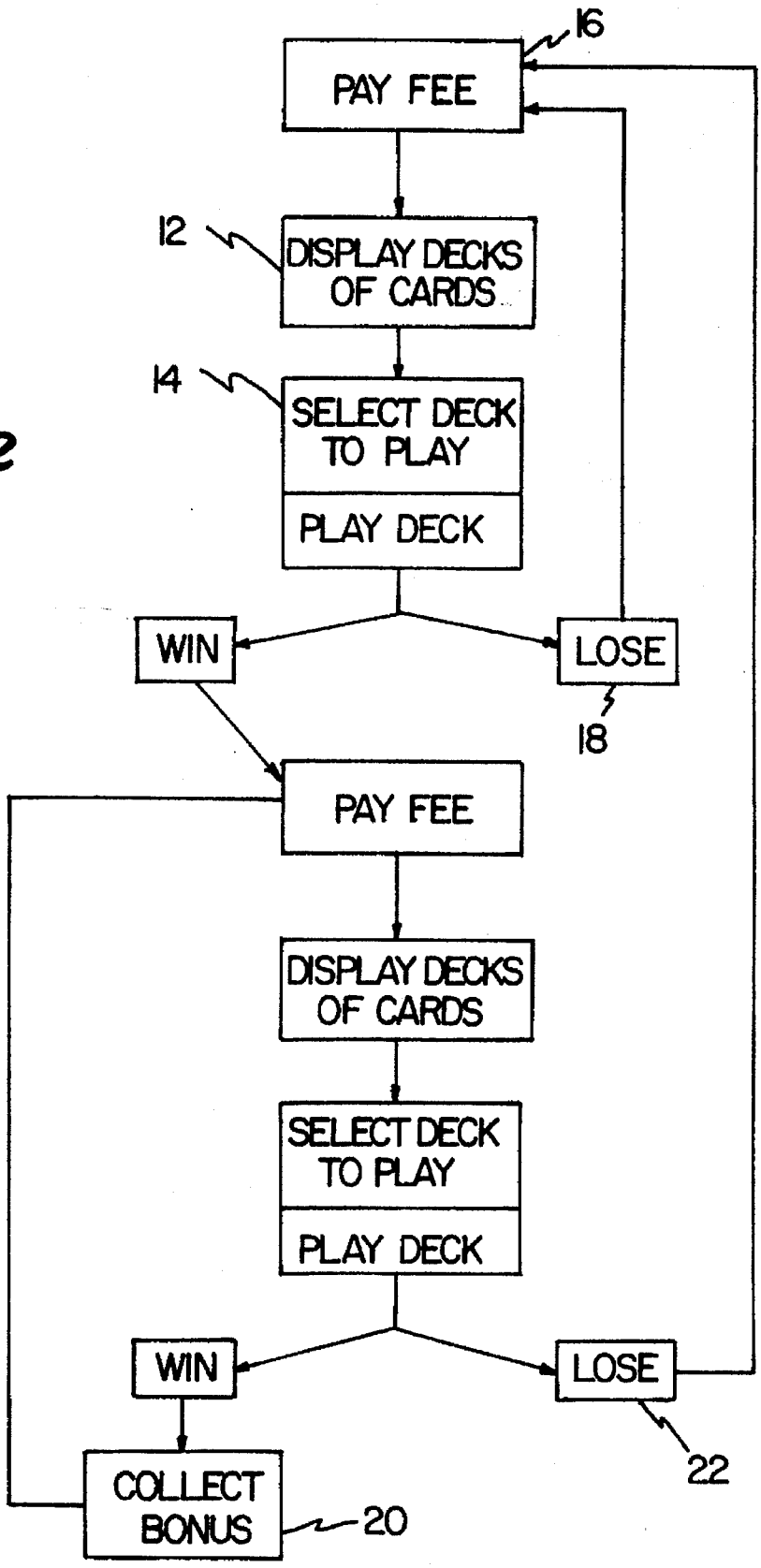
FIG. 2 is a schematic view of one embodiment of the game of the present invention with a single fee arrangement.

In one embodiment, prior to viewing the cards, the player pays a fee that does not change from game to game. This embodiment is shown in FIG. 2. In another embodiment, the player pays a fee that increases with each successive game played for a bonus. This embodiment is shown in FIG. 1. This type of fee is a winner's fee. In another embodiment, illustrated in FIG. 3, the player pays a single, up-front fee to play a defined number of games.

The fee can be regarded as a bet that the player will remove all of the cards in the deck from play and will win the game. The fee can also be regarded as a payment for the pleasure of playing solitaire. The fee may be paid by coin, token, input of a credit card number, debit card number or other conventional method of payment used in conjunction with personal computers and gambling devices. In one embodiment, the player obtains a debit card with a defined upper limit that may only be used to play the game of the present invention. Once the upper limit is reached, access to further games is denied.

Once the fee is paid, the player selects the first deck to play. The game is played in accordance with conventional rules of one of the type of solitaire games listed above.

In one embodiment, the player has a defined amount of time to make the selection. If the player fails to make the selection in the allotted time, a deck is selected for the player by actuation of selecting software that is actuated by a timer.

Once the player selects the deck to play, the player plays the first game. The cards in the deck are played in accordance with conventional rules utilizing conventional electronic software and hardware. In a game such as Klondike solitaire, the player wins if the player turns up all of the cards and arranges the cards in terms of color and order from King to Ace. In one embodiment, the player who succeeds in turning up all of the cards and ordering the cards in the first game is a winning player and wins a chance to play the second game of solitaire for a winner's bonus. In another embodiment, the winning player must have multiple wins or must have a high score after playing a collection of decks to win the winner's bonus.

In one embodiment, the player additionally wins a bonus for turning up and ordering a predetermined number of cards of the first hand played even though the player has not turned up all of the cards. The bonus is paid according to a schedule of turned up cards. In another embodiment, the player wins a bonus for turning up particular cards. A player winning this type of bonus is not eligible to play the next game for the winner's bonus unless the player wins the game.

In one embodiment, players may win a bonus payment by turning up all of the cards and ordering the cards within a defined period of time. In another embodiment, players have a defined time limit to turn up and order the cards. The game is electronically ended and scored after a prescribed time interval. Players winning this type of bonus payment are also eligible to play the next game for the winner's bonus.

The winner's bonus payment for winning the second game; that is, turning up and ordering all of the cards in the second game, is significantly greater than the amount of any bonus payment that may be paid during the first game.

A reduced bonus payment may also be paid for turning over and ordering a predetermined number of cards in the second hand. In another embodiment, the player must turn up particular cards to win the bonus.

In order to play the third game, the player must win the second game and pay a fee. As discussed, in one embodiment shown in FIG. 1, the fee for a winning player to play successive games for the winner's bonus is increased for each successive game. In another embodiment shown in FIG. 2, the fee is not increased from one winning game to another winning game. In one embodiment, shown in FIGS. 1 and 2, if the winning player chooses not to pay the increased fee, the player may play the game of solitaire but will not be eligible for the winner's bonus. In another embodiment shown in FIG. 2, the winning player need only pay a fee of the same value as paid to play the previous game.

If the player wins the third game, the player wins a winner's bonus that is greater than the winner's bonus for the second game.

Figure 3:
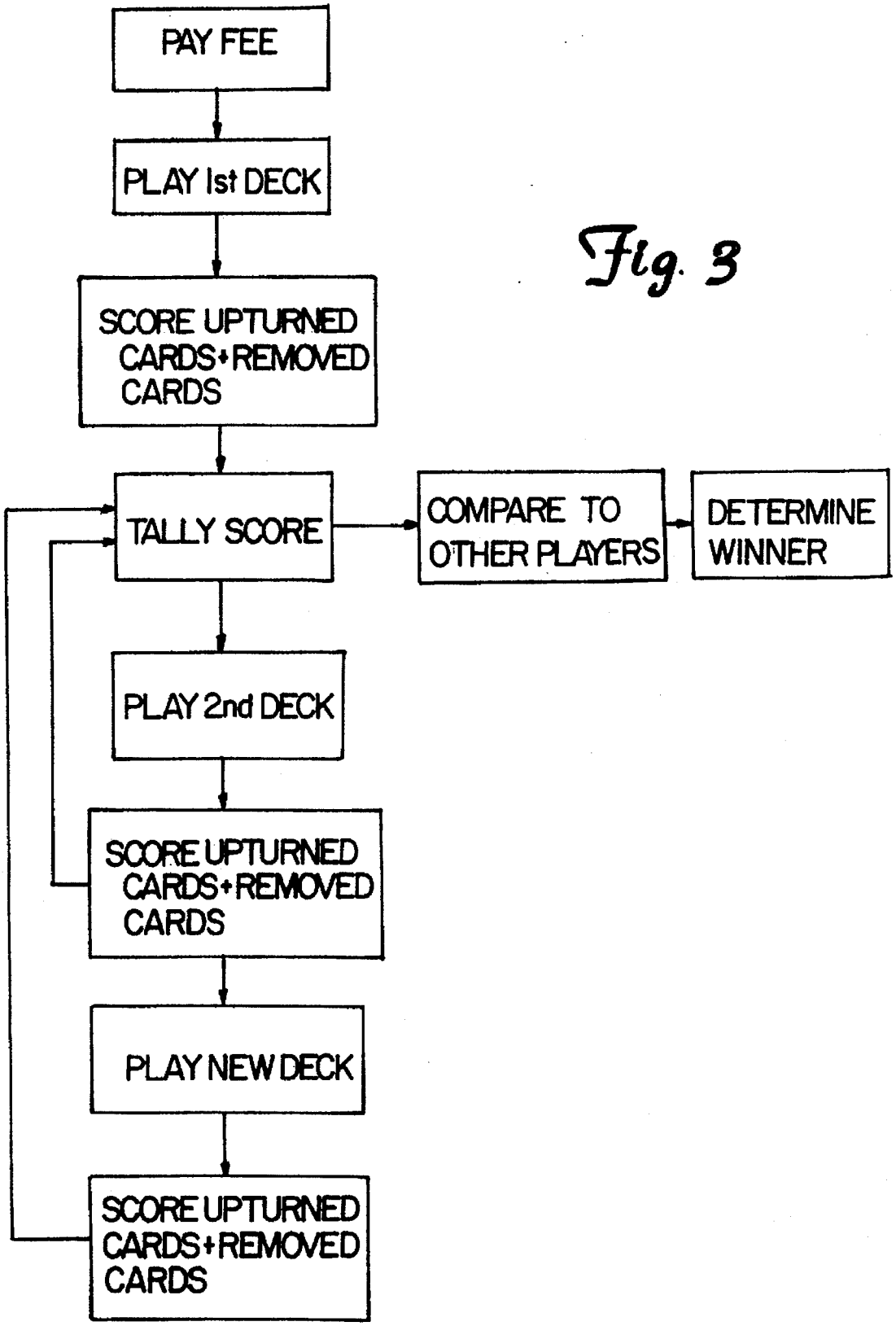
FIG. 3 is a schematic view of one embodiment of the present invention with a player playing multiple decks for a single fee.

In one other embodiment of the method for playing solitaire of the present invention shown in FIG. 3, the player pays a single fee to play a predetermined number of decks. The player plays as one player in a player pool. This embodiment may be played in an environment such as a tavern or pub. Each player in this embodiment plays multiple decks of cards to play a game. In one embodiment, each player plays fifty decks of cards. Each deck is ordered the same so that the players play the same decks.

In one embodiment, the player in the pool with the greatest number of wins per number of decks played wins the game. In another embodiment, the player in the pool with the best score wins. In this embodiment, the player receives a score based upon the value and number of cards removed from the game.

In one embodiment, after paying the fee, each player obtains a Personal Identification Number, PIN, that permits software to maintain a record of wins and losses, cards upturned, cards removed from the game, decks played and decks remaining to be played by the player. The use of the PIN also permits the player to stop a game and resume the game at a later date without having to pay another fee or start over.

The bonuses for all game embodiments are paid with earnings from the fees. It is estimated that about 2.5 to 4 percent of players playing the first game will be eligible for the winner's bonus shown in FIGS. 1 and 2 because these players will win the game. It is estimated that about 95% of players playing the first game will play the second game.

It is estimated that about 95% of individuals winning the first game shown in FIGS. 1 and 2 will pay a fee and play the second game for the winner's bonus. It is estimated that about 2.5 to 4 percent of individuals playing the second game will win the winner's bonus in the second game.

It is estimated that about 95 percent of individuals winning the second game will pay the fee and play the third game. It is estimated that about 2.5 to 4% of individuals playing the third game will win the third game.

It is believed that each individual playing each game has a chance of about 1 in 30 of winning the game. Each individual has a chance of about 1 in 900 of winning two consecutive games, (30×30). Each individual has about a 1 in 27,000 chance of winning three consecutive games, (30×30×30). Each individual has about a 1 in 810,000 chance of winning four consecutive games, (30×30×30×30). Each individual has about a 1 in 24,300,000 chance of winning five consecutive games, (30×30×30×30×30).

In one embodiment such as shown in FIG. 2, a fixed amount of money from each fee collected from each game is used to pay the winner's bonus. In another embodiment such as is shown in FIG. 1, more money is collected from fees paid by each game winner to play another game than from fees paid by each game loser to play another game. This additional money may be collected from a higher fee charged to winners. This additional money may also be collected by collecting a greater percentage from a fixed fee.

In one embodiment, the fee is apportioned so that the house receives a fraction and equal fractions are apportioned winner's bonuses for each game from the second game on, played by each player. In another embodiment, the fractions for the winner's bonuses are not equal.

Figure 4:
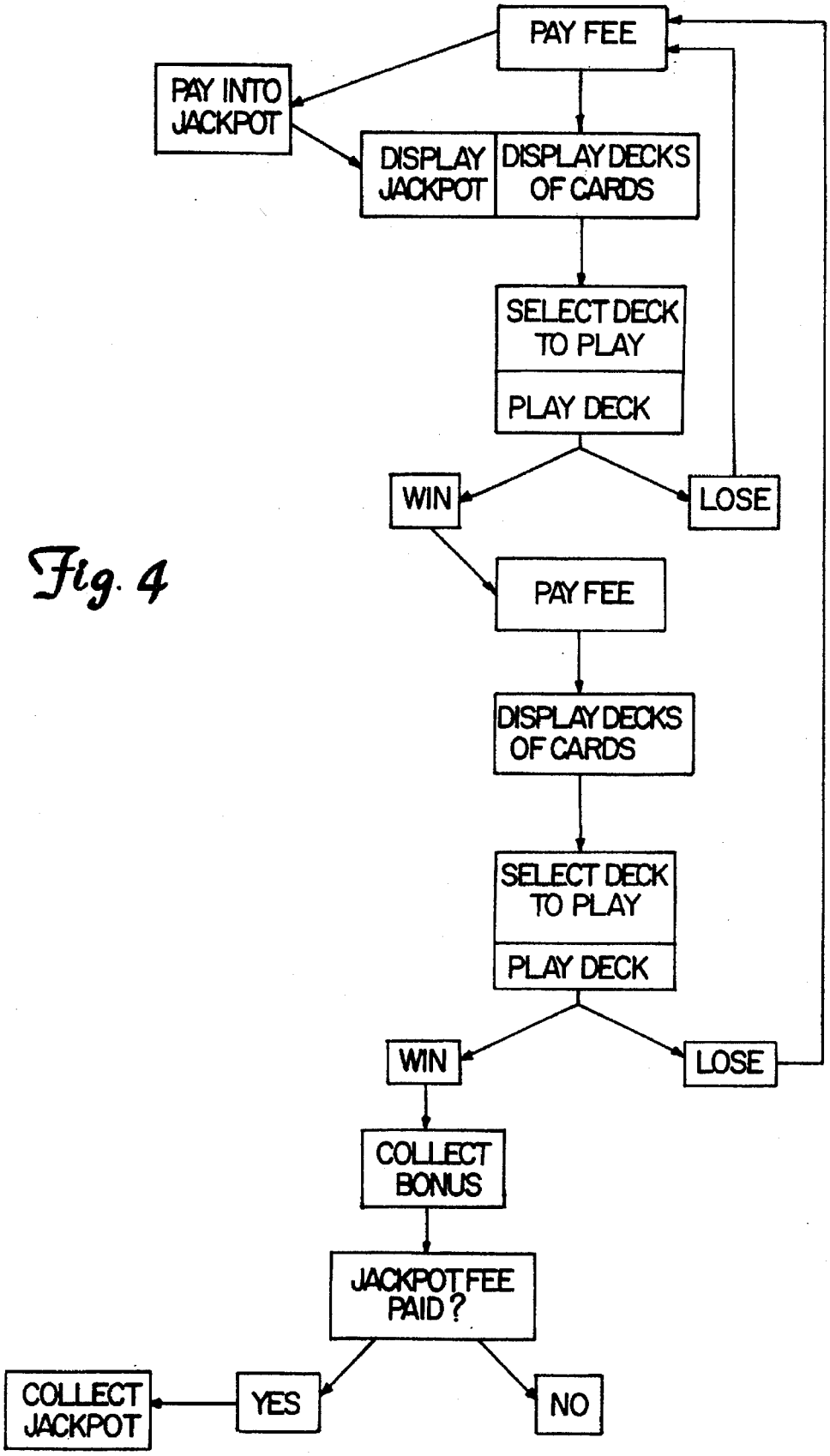
FIG. 4 is a schematic view of one embodiment of the present invention with a jackpot feature.

In another embodiment illustrated schematically in FIG. 4, each game played can be played for a progressive jackpot. The jackpot contribution may be collected from the fee. In another embodiment, the jackpot contribution is collected from a separate jackpot contribution made by the player in addition to the fee. The player may select the progressive jackpot option from a menu screen. In another embodiment, the player is automatically eligible for the progressive jackpot once the player has paid the fee to play the game.

The player playing for the progressive jackpot is informed of the magnitude of the jackpot by a meter displayed with the deck of cards. Information that the player is playing for the progressive jackpot is relayed from the player's device to all other devices concurrently used by players playing for the progressive jackpot.

In one embodiment, the progressive jackpot is paid to a winner of one of the third, fourth or more consecutive wins; that is, the player winning three consecutive games wins the progressive jackpot as it is valued at the instant the player wins.

In another embodiment, players winning any game receive a percentage of the progressive jackpot as it is valued at the instant the players win. Winnings from the progressive jackpot for this embodiment will vary depending upon the amount of money in the jackpot at the instant the player wins. For instance, if significant contributions are accumulated in the jackpot before a first player wins the jackpot, the first player will win a substantial jackpot. If a second player wins shortly after the first player wins, before significant contributions are made to the jackpot, the second player's winnings will be less than the first player's winnings.

In one other embodiment, players winning a game win a fraction of the progressive jackpot. The fraction is determined by the number of cumulative wins for the player. The greater the number of cumulative wins, the greater the fraction of the progressive jackpot won.

Although the present invention has been described with reference to preferred embodiments, workers skilled in the art will recognize that changes may be made in form and detail without departing from the spirit and scope of the invention.

What is claimed is:

1. A game of electronic solitaire, comprising the steps of:

providing means so that a player can pay a fee and select a solitaire deck to play a first game;

electronically generating at least one deck of cards for a solitaire game;

displaying one or more of the decks to a player so that the player views a predetermined number of upturned cards of each deck after paying the fee;

providing means so that the player can select and play the deck and win or lose the first game;

providing means so that the player can pay a fee and select one of at least two solitaire decks to play for a winner's bonus in a second game provided the player wins the first game; and providing means to pay the winner's bonus to the player, provided the player wins the second game.

2. The game of claim 1 wherein the fee to play the second game is greater than the fee to play the first game.

3. The game of claim 1 wherein the fee to play the second game is the same as the fee to play the first game.

4. The game of claim 1 wherein two or more decks are generated for the solitaire game.

5. The game of claim 1 wherein the player must remove all of the cards in the deck from play to win the game.

6. The game of claim 1 and further including providing means so that the player can pay a fee and select a deck to play from two or more decks, for a winner's bonus in a third hand.

7. The game of claim 6 wherein the fee for playing each of the first, second and third games is about the same.

8. The game of claim 6 wherein the third game winner's bonus is greater than the second game winner's bonus.

9. The game of claim 6, wherein the fee for playing the third game is greater than the fee for playing the second game.

10. The game of claim 6 wherein the third game must be played within a prescribed period of time to win.

11. The game of claim 1 wherein the first game must be played within a prescribed period of time to win.

12. The game of claim 1 wherein the second game must be played within a prescribed period of time to win.

13. The game of claim 1 following rules of a solitaire game selected from the group consisting of Simple Addition, Block Solitaire, Baroness, Fourteen Puzzle,Pyramid, Nestor, Monte Carlo, Decade, Betrothal, Accordian, Golf, Hit or Miss, Idiot's Delight, Royal Flush, Perpetual Motion, Clock, Eight-Day Clock, Auld Lang Syne, Sir Tommy, Puss Corner, Calculation, Four Kings, Quadrille, Thirteen Down, Queen's Audience, Scorpion, Klondike, Agnus, Thumb and Pouch, Whitehead, Westcliff, Aces Up, Spiderette, Will o' the Wisp, Four Seasons, Simplicity, Fortune's Favor, Chameleon, Storehouse, Gate, Beleaguered Castle, Citadel, Streets and Alleys, Fortress, Chessboard, Le Belle Lucie, Trefoil, Flower Garden, Shamrocks, King Albert, Baker's Dozen, Good Measure, Perseverance, Little Spider, Grandfather's Clock, Bisley, Pendulum, Poker Solitaire and Cribbage Solitaire.

14. The game of claim 1 wherein the winner's bonus is collected as a fixed amount from each fee paid.

15. The game of claim 1 wherein the winner's bonus is collected in a greater amount from the second fee than from the first fee.

16. The game of claim 1 and further including a jackpot for which the player is eligible upon payment of the fee.

17. The game of claim 1 and further including a jackpot for which the player is eligible upon payment of a jackpot contribution with the fee.

18. The game of claim 17 following rules of a solitaire game selected from the group consisting of Simple Addition, Block Solitaire, Baroness, Fourteen Puzzle,Pyramid, Nestor, Monte Carlo, Decade, Betrothal, Accordian, Golf, Hit or Miss, Idiot's Delight, Royal Flush, Perpetual Motion, Clock, Eight-Day Clock, Auld Lang Syne, Sir Tommy, Puss Corner, Calculation, Four Kings, Quadrille, Thirteen Down, Queen's Audience, Scorpion, Klondike, Agnus, Thumb and Pouch, Whitehead, Westcliff, Aces Up, Spiderette, Will o' the Wisp, Four Seasons, Simplicity, Fortune's Favor, Chameleon, Storehouse, Gate, Beleaguered Castle, Citadel, Streets and Alleys, Fortress, Chessboard, Le Belle Lucie, Trefoil, Flower Garden, Shamrocks, King Albert, Baker's Dozen, Good Measure, Perseverance, Little Spider, Grandfather's Clock, Bisley, Pendulum, Poker Solitaire and Cribbage Solitaire.

19. A method for playing a game of solitaire, comprising:

paying a fee to select one of one or more decks of shuffled cards and to play solitaire with the deck of cards selected;

selecting a shuffled deck of cards to play a first game of solitaire from one or more shuffled decks wherein each of the shuffled decks display a predetermined number of upturned cards;

playing the deck of cards to win or lose the first game;

paying a fee to play a second game of solitaire for a winner's bonus provided the player wins the first game;

selecting a shuffled deck of cards to play the second game from one or more shuffled decks wherein each of the shuffled decks displays a predetermined number of upturned cards;

playing the second game to either win or lose the game; and collecting the winner's bonus and obtaining an eligibility to play a third game for a winner's bonus provided the player wins the second game.

20. The method of claim 19 wherein the fee for playing the second game is the same-as the fee for playing the first game.

21. The method of claim 19 wherein the fee for playing the second game is greater than the fee for playing the first game.

22. The method of claim 19 wherein the method includes paying a fee to select one of two or more decks of shuffled cards.

23. The game of claim 18 played on an electronic device.

24. A method for playing a game of solitaire, comprising:

paying a fee to play a preselected number of decks of cards wherein each player playing the game plays decks having the same arrangement of cards;

playing each of the decks of cards wherein cards are turned up during play and removed from play and wherein cards turned up or removed for each deck are tallied to produce a score; and paying a winner's bonus to the player having the best score.

25. The game of claim 24 wherein the number of decks that each player plays is 50.

26. The game of claim 24 wherein each of the decks of cards must be played within a defined time interval to win.

27. The game of claim 24 wherein the decks of cards are displayed and played on an electronic device.

28. The game of claim 24 wherein the best score is the highest score.

29. The game of claim 24 wherein the best score is the lowest score.

* * * * *

UNITED STATES PATENT AND TRADEMARK OFFICE

CERTIFICATE OF CORRECTION

PATENT NO. : 5,653,635

DATED : Aug. 5, 1997

INVENTOR(S) : JOHN G. BREEDING

It is certified that error appears in the above-indentified patent and that said Letters Patent is hereby corrected as shown below:

Col.. 4, line 19, after the word "ascending", delete the word "of" and add the word --or--

Col. 10, line 31, delete the punctation mark "hyphen" between the words "same" and "as".

Signed and Sealed this

Twenty-fifth Day of November, 1997

*Attest:*

Bruce Lehman

BRUCE LEHMAN

*Attesting Officer*

*Commissioner of Patents and Trademarks*